United States Patent [19]

Newman et al.

[11] Patent Number: 4,720,338

[45] Date of Patent: Jan. 19, 1988

[54] PREMIUM COKING PROCESS

[75] Inventors: Bruce A. Newman, Ponca City; John K. Shigley, Stillwater; Ta-Wei Fu, Ponca City, all of Okla.

[73] Assignee: Conoco Inc., Ponca City, Okla.

[21] Appl. No.: 926,039

[22] Filed: Nov. 3, 1986

[51] Int. Cl.[4] ..... C10G 9/14

[52] U.S. Cl. ..... 208/131; 208/50

[58] Field of Search ..... 208/131, 50

[56] References Cited

U.S. PATENT DOCUMENTS 2,922,755 10/1957 Hackley ..... 208/39
3,896,023 7/1975 Ozaki et al. .
4,043,898 8/1977 Kesler ..... 208/131 X
4,518,486 5/1985 Jansma ..... 208/131
4,547,284 10/1985 Sze et al. ..... 208/131 X

FOREIGN PATENT DOCUMENTS 899630 1/1982 U.S.S.R. .

*Primary Examiner*—John Doll
*Assistant Examiner*—Glenn A. Caldarola

[57] ABSTRACT

A process for providing more uniform premium coke in a delayed coking operation by adding an aliphatic petroleum fraction to the premium coking feed during the latter part of the coking cycle. Preferably the aliphatic petroleum fraction is added gradually and is increased in quantity over the period of addition.

6 Claims, 1 Drawing Figure

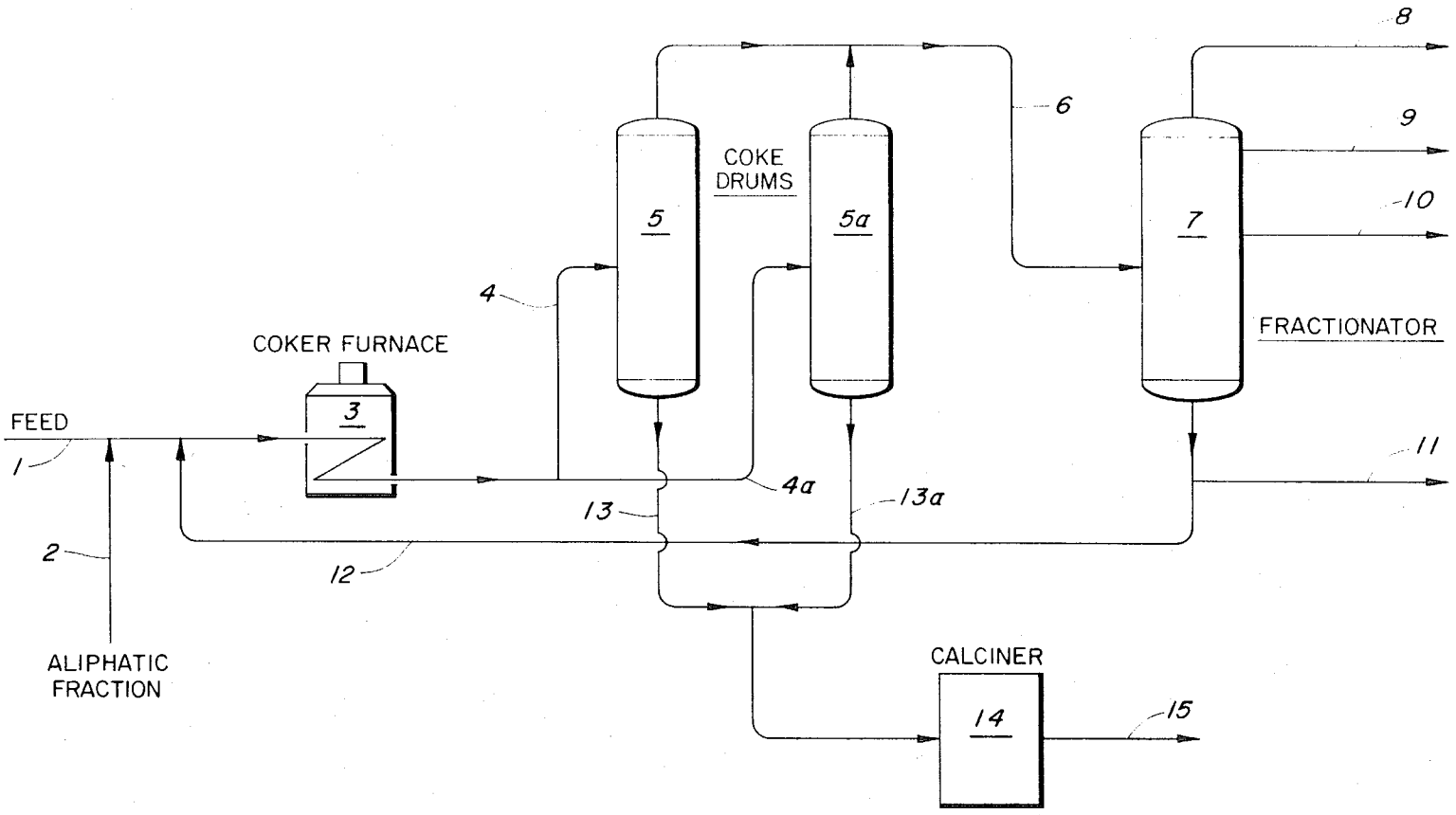
8
9
10
FRACTIONATOR
11
7
6
15
CALCINER
14
13a
5a
4a
COKE DRUMS
5
13
4
COKER FURNACE
3
12
FEED
1
2
ALIPHATIC FRACTION

PREMIUM COKING PROCESS

BACKGROUND AND SUMMARY OF THE INVENTION

There is an increasing demand for high quality premium coke for the manufacture of large graphite electrodes for use in electric arc furnaces employed in the steel industry. The quality of premium coke used in graphite electrodes is often measured by its coefficient of thermal expansion which may vary from as low as $-5$ to as high as $+8$ centimeters per centimeter per degree centigrade times $10^{-7}$. Users of premium coke continuously seek graphite materials having lower CTE values. Even a small change in CTE can have a substantial effect on large electrode properties.

Premium coke is manufactured by delayed coking in which heavy hydrocarbon feedstocks are converted to coke and lighter hydrocarbon products. In the process the heavy hydrocarbon feedstock is heated rapidly to cracking temperatures and is fed into a coke drum. The heated feed soaks in the drum in its contained heat which is sufficient to convert it to coke and cracked vapors. The cracked vapors are taken overhead and fractionated with the fractionator bottoms being recycled to the feed if desired. The coke accumulates in the drum until the drum is filled with coke at which time the heated feed is diverted to another coke drum while the coke is removed from the filled drum. After removal the coke is calcined at elevated temperatures to remove volatile materials and to increase the carbon to hydrogen ratio of the coke.

In the manufacture of large graphite electrodes, calcined premium coke particles obtained from the delayed coking process are mixed with pitch and then baked at elevated temperatures to carbonize the pitch.

The delayed coking operation is a batch process in which the feed material is introduced to the coke drum during the entire coking cycle. If the coking cycle lasts for say 30 hours the feed material first introduced to the coke drum is subjected to coking conditions for this period of time. Each succeeding increment of feed however, is coked for a lesser period of time and the final portion of feed material introduced to the coke drum is subjected to coking conditions only for a relatively short period of time. In view of this it is understandable that problems are encountered in obtaining coke product which is homogeneous. Coke produced near the top of the drum where reaction times are short, generally has different physical properties than coke produced in the remainder of the drum. Coke which is not uniform presents a problem for graphite producers in a number of ways. Pitch demand, coke sizing, and ultimate electrode performance all become difficult to predict if coke properties are not consistent.

According to this invention, premium coke having more unform properties is produced by adding an aliphatic petroleum fraction to the feed to the premium delayed coker during the latter part of the coking cycle. Preferably, the aliphatic petroleum fraction is added gradually in increasing amounts over a period of time.

PRIOR ART

U.S. Pat. No. 2,922,755 discloses a method for manufacturing graphitizable petroleum coke by delayed coking of a mixed feedstock made up of approximately 70 to 90 percent of a highly aromatic thermal tar and from about 10 to 30 percent of one or more refinery residues including virgin reduced crude.

Russian Pat. No. 899,630 relates to a delayed coking process for coking a raw material such as petroleum residue tar and a coking distillate such as heavy gas oil. The mixture of the materials is supplied to the top of the reactor either throughout the coking cycle or during the latter part of the cycle.

U.S. Pat. No. 3,896,023 discloses a process for producing synthetic coal by treating a heavy hydrocarbon such as atmospheric residual oil or vacuum residual oil to increase the aromaticity factor $f_a$ to values greater than 0.4 and then coking the composition. Alternatively, the heavy hydrocarbon is blended with thermal tar to increase its aromaticity factor $f_a$ prior to the coking operation. (The procedure for calculating $f_a$ is set forth in this patent).

BRIEF DESCRIPTION OF THE DRAWING

The drawing is a schematic flow diagram of a premium delayed coker which illustrates the invention.

DETAILED DESCRIPTION OF THE INVENTION

The fresh feedstocks used in carrying out the invention are heavy aromatic mineral oil fractions having an aromatic carbon content ($f_a$) as measured by carbon—13 NMR of at least about 40 percent. These feedstocks can be obtained from several sources including petroleum, shale oil, tar sands, coal and the like. Specific feedstocks include decant oil, also known as slurry oil or clarified oil, which is obtained from fractionating effluent from the catalytic cracking of gas oil and/or residual oils. Thermal tar may also be used as a feedstock. This is a heavy oil which is obtained from the fractionation of material produced by thermal cracking of gas oil or similar materials. Another feedstock which may be used is extracted coal tar pitch. In addition, gas oils, such as heavy premium coker gas oil or vacuum gas oil, may also be used in the process. Any of the preceding feedstocks may be used singly or in combination. In addition any of the feedstocks may be subjected to hydrotreating and/or thermal cracking prior to their use for the production of premium grade coke.

The aliphatic petroleum fractions employed in the practice of the invention are usually residual oils obtained from atmospheric or vacuum distillation of crude oil or thermal or catalytic cracking operations. Other heavy oils such as heavy gas oils may also be used. Since the material used is primarily aliphatic in nature the aromaticity is low and in terms of $f_a$ will not exceed about 25 percent. In addition the aliphatic petroleum fraction will have a Richfield pentane insolubles content less than 15 weight percent.

Referring now to the drawing, feedstock is introduced into the coking process via line 1. The feedstock which in this instance is a thermal tar is heated in furnace 3 to temperatures normally in the range of about 850° F. to about 1100° F. and preferably between about 900° F. to about 975° F. A furnace that heats the thermal tar rapidly to such temperatures such as a pipestill is normally used. The thermal tar exits the furnace at substantially the above indicated temperatures and is introduced through line 4 into the bottom of coke drum 5 which is maintained at a pressure of between about 15 and about 200 psig. The coke drum operates at a temperature in the range of about 800° F. to about 1000° F., more usually between about 820° F. and about 950° F.

Inside the drum the heavy hydrocarbons in the thermal tar crack to form cracked vapors and premium coke.

During the latter part of the coking cycle, usually at about the midpoint, an aliphatic petroleum fraction is introduced to the coker feed through line 2. Preferably this material is added gradually during the remainder of the coking cycle. While it may be introduced at a constant rate it is preferred to start the addition with a small amount and gradually increase the flow rate until a maximum is reached at the end of the coking cycle. It has been found that addition of the aliphatic petroleum fraction does not provide favorable results during the early part of the coking cycle and may even have an adverse effect. In addition toward the end of the coking cycle larger amounts of this material are required to provide optimum results. A specific rate of increase in the addition of the aliphatic petroleum fraction is not required. The rate may be either linear or nonlinear. In any event it is desirable to add the aliphatic petroleum fraction in amounts and during the time period in the coking cycle effective to maximize uniformity of the premium coke product. To obtain this result the amount of aliphatic petroleum fraction initially added to the feed is between about 5.0 weight percent and about 50.0 weight percent of the combined mixture of aliphatic petroleum fraction and the aromatic mineral oil feedstock. The amount of added aliphatic petroleum fraction preferably is gradually increased to between about 50.0 weight percent and about 95.0 weight percent of the mixture at the end of the coking cycle. In terms of total feed to the coker during a coking cycle the aliphatic petroleum fraction will vary from about 15 weight percent to about 70 weight percent of the combined mixture of aliphatic petroleum fraction and the aromatic mineral oil feedstock.

While the drawing shows the aliphatic petroleum fraction being combined with the feedstock before the feedstock enters the furnace it may if desired be combined with the effluent from the furnace or it may be separately introduced to coke drums 5 and **5*a***.

Returning now to the drawing, vapors produced during the coking operation are continuously removed overhead from coke drum 5 through line 6. The coke accumulates in the drum until it reaches a predetermined level at which time the feed to the drum is shut off and switched to a second coke drum **5*a* wherein the same operation is carried out. This switching permits drum 5** to be taken out of service, opened, and the accumulated coke removed therefrom using conventional techniques. The coking cycle may require between about 16 and about 60 hours but more usually is completed in about 24 to about 48 hours.

The vapors that are taken overhead from the coke drums are carried by line 6 to a fractionator 7. As indicated in the drawing, the vapors will typically be fractionated into a $C_1$–$C_3$ product stream 8, a gasoline product stream 9, a light gas oil product stream 10 and a premium coker heavy gas oil taken from the fractionator via line 11.

As indicated previously the premium coker heavy gas oil from the fractionator may be recycled at the desired ratio to the coker furnace through line 12. Any excess net bottoms may be subjected to conventional residual refining techniques if desired.

Green coke is removed from coke drums 5 and **5*a* through outlets 13 and 13*a*, respectively, and introduced to calciner 14 where it is subjected to elevated temperatures to remove volatile materials and to increase the carbon to hydrogen ratio of the coke. Calcination may be carried out at temperatures in the range of between about 2000° F. and about 3000° F. and preferably between about 2400 and about 2600° F. The coke is maintained under calcining conditions for between about one half hour and about ten hours and preferably between about one and about three hours. The calcining temperature and the time of calcining will vary depending on the density of the coke desired. Calcined premium coke which is suitable for the manufacture of large graphite electrodes is withdrawn from the calciner through outlet 15**.

The following examples illustrate the results obtained in carrying out the invention.

EXAMPLE 1

A thermal tar, with physical properties shown in Table 3, was coked at 860° F. and 60 psig for 4, 8, 16 and 32 hours. The table below shows the CTE of coke obtained in these experiments:

TABLE 1

| Coking Time, Hr | Coke CTE, $10^{-7}$/°C. |
|---|---|
| 4 | 8.1 |
| 8 | 3.2 |
| 16 | 1.9 |
| 32 | 1.7 |
| | Average = 3.7 |

An aliphatic resid, with physical properties also shown in Table 3, was blended with the thermal tar at the two different compositions as follows:

| Blend 1 | Blend 2 |
|---|---|
| 55 wt % resid | 75 wt % resid |
| 45 wt % thermal tar | 25 wt % thermal tar |

Blends 1 and 2 were coked at 860° F. and 60 psig for 4, 8, 16 and 32 hours. Table 2 compares CTE results from these blends with CTE results from the pure thermal tar:

TABLE 2

| | COKE CTE, $10^{-7}$/°C. | | |
|---|---|---|---|
| Coking Time, Hr | Thermal Tar | Blend 1 | Blend 2 |
| 4 | 8.1 | 4.5 | 4.1 |
| 8 | 3.2 | 2.0 | 2.4 |
| 16 | 1.9 | 2.1 | 2.6 |
| 32 | 1.7 | 1.6 | 1.9 |

Including resid in the coker feed is beneficial to coke CTE for the 4 and 8 hour coking times. Hence, producing the most consistent coke and coke with best overall CTE would involve addition of resid toward the end of the charge cycle (when coking times are short). It is also noted that increasing the amount of resid added toward the end of the coking cycle has an increased beneficial effect on coke CTE. For example, we can visualize the feedstock composition changing as follows:

| Coking Time | % Resid in Blend | Coke CTE, $10^{-7}$/°C. |
|---|---|---|
| 4 | 75 | 4.1 |
| 8 | 55 | 2.0 |
| 16 | 0 | 1.9 |
| 32 | 0 | 1.7 |
| | | Average = 2.4 |

It is apparent from the data that increasing the amount of resid at low coking times (near the end of the coking cycle) causes coke CTE to be more consistent than values presented in Table 1 and the overall average coke CTE to be lower.

TABLE 3

| Feedstock Description | Aliphatic Resid | Thermal Tar |
|---|---|---|
| Specific Gravity, 60/60° F. | 0.888 | 1.034 |
| API Gravity | 27.8 | 5.40 |
| D-1160 Distillation, °F. @ 760 MM | | |
| 5 Vol % | 530 | 613 |
| 10 | 599 | 679 |
| 20 | 694 | 714 |
| 30 | 750 | 734 |
| 40 | 816 | 767 |
| 50 | 910 | 799 |
| 60 | | 850 |
| 70 | | 904 |
| End Point | 932 | 964 |
| Recovery | 53.0 | 79.0 |
| Conradson Carbon Residue, Wt % | 4.29 | 6.65 |
| Pentane Insolubles, Wt % | 5.89 | 2.78 |
| Metals, ppm | | |
| V | <1.0 | <1.0 |
| Ni | 13.0 | <1.0 |
| Fe | <4.0 | <4.0 |
| C13 NMR, % Aromatic C Atoms ($f_a$) | 16.5 | 55.8 |

EXAMPLE 2

A decant oil, with physical properties shown in Table 5 was coked at 855° F. and 875° F. and 60 psig for 8 hours. Another run was made at 855° F. and 60 psig for 72 hours. A mixture of resid, with physical properties shown in Table 5, and the same decant oil was coked at the same conditions. Table 4 compares the results of these coking operations.

TABLE 4

| Coking Time, Hr | Coking Temperature, °F. | Coke CTE, $10^{-7}$/°C. 100% Decant Oil Feed | 70% Wt % Resid 30 Wt % Decant Oil Feed |
|---|---|---|---|
| 8 | 855 | 4.0 | 2.5 |
| 8 | 875 | 2.9 | 1.9 |
| 72 | 855 | 1.6 | 1.9 |

Here again the addition of aliphatic resid when the reaction time is short (near the end of the coking cycle) provides coke with more consistent CTE values.

TABLE 5

| Feedstock Description | Decant Oil | Aliphatic Resid |
|---|---|---|
| Specific Gravity, 60/60° F. | 1.062 | 0.888 |
| API Gravity | 1.70 | 27.8 |
| D-1160 Distillation, °F. @ 760 MM | | |
| 5 Vol % | 584 | 530 |
| 10 | 611 | 599 |
| 20 | 632 | 694 |
| 30 | 650 | 750 |
| 40 | 665 | 816 |
| 50 | 681 | 910 |
| 60 | 702 | |
| 70 | 734 | |
| 80 | 799 | |
| 90 | 881 | |
| End Point | 881 | 932 |
| Recovery | 90.0 | 53.0 |
| Sulfur, Wt % | 1.09 | |
| Metals, ppm | | |
| V | <2.0 | <1.0 |
| Ni | <2.0 | 13.0 |
| Fe | <8.0 | <4.0 |

TABLE 5-continued

| Feedstock Description | Decant Oil | Aliphatic Resid |
|---|---|---|
| C13 NMR, % Aromatic C Atoms ($f_a$) | 65.0 | 16.5 |

EXAMPLE 3

A thermal tar having properties set forth in Table 7 was coked at 860° F. and 890° F. and 60 psig for 2, 4, 8, 16 and 32 hours. A 50:50 mixture of resid, with physical properties shown in Table 5, and the same thermal tar was coked at the same conditions. The results are shown in Table 6.

TABLE 6

| Reaction Time, Hr | Coke CTE, $10^{-7}$/°C. Coking Temperature, 860° F. Thermal Tar | 50:50 Feedstock Blend | Coking Temperature, 890° F. Thermal Tar | 50:50 Feedstock Blend |
|---|---|---|---|---|
| 2 | — | | 10.8 | 5.50 |
| 4 | 7.82 | 5.95 | 2.63 | 2.27 |
| 8 | 2.25 | 1.12 | 1.42 | 2.16 |
| 16 | 1.16 | 1.72 | 1.57 | 2.08 |
| 32 | 1.09 | 0.98 | 1.15 | 1.74 |

Here again the benefits from adding resid to the coking feedstock during the latter part of the coking cycle are readily apparent.

TABLE 7

| Feedstock Description | Thermal Tar |
|---|---|
| Specific Gravity, 60/60° F. | 0.986 |
| API Gravity | 12.0 |
| D-1160 Distillation, °F. @ 760 MM | |
| 5 Vol % | 580 |
| 10 | 607 |
| 20 | 643 |
| 30 | 706 |
| 40 | 736 |
| 50 | 767 |
| 60 | 809 |
| 70 | 835 |
| 80 | 875 |
| End Point | 894 |
| Recovery | 83.0 |
| Conradson Carbon Residue, Wt % | 1.89 |
| C13 NMR, % Aromatic C Atoms | 35.6 |

We claim:

1. In a delayed premium coking process in which an aromatic mineral oil feedstock having an $f_a$ of at least about 40 and selected from the group consisting of decant oil, gas oil, thermal tar and extracted coal tar pitch is combined with conventional recycle and coked at premium coking conditions, the improvement comprising adding to said feedstock and natural recycle during about the latter half of the fill cycle an aliphatic petroleum residual oil fraction having an $f_a$ below about 25 and a Richfield pentane insolubles content of less than 15 weight percent whereby the coke formed during the latter part of the fill cycle will have a CTE value more near that of the coke formed during the initial part of the fill cycle than would be the case if the aliphatic material were not added.

2. The process of claim 1 in which the total amount of aliphatic petroleum fraction added during the coking cycle is between about 15 weight percent and about 70 weight percent of the combined mixture of aliphatic petroleum fraction and the aromatic mineral oil feedstock.

3. The process of claim 2 in which the amount of aliphatic petroleum fraction added is gradually increased to reach a maximum at the end of the coking cycle.

4. The process of claim 3 in which the amount of aliphatic petroleum fraction initially added is between about 5.0 weight percent and about 50.0 weight percent of the combined mixture of aliphatic petroleum fraction and the aromatic mineral oil feedstock and the amount added by the end of the coking cycle is between about 50.0 weight percent and about 95.0 weight percent.

5. The process of claim 4 in which the aromatic mineral oil feedstock is a thermal tar.

6. The process of claim 5 in which the aliphatic petroleum fraction is a residual oil.

* * * * *